US007219380B2

(12) United States Patent
Beck et al.

(10) Patent No.: US 7,219,380 B2
(45) Date of Patent: May 22, 2007

(54) MULTICOMPARTMENTED AIR MATTRESS

(75) Inventors: David B. Beck, West Jordan, UT (US); Ronald Lopez, Draper, UT (US)

(73) Assignee: R&D Products, LLC, Midvale, UT (US)

( * ) Notice: Subject to any disclaimer, the term of this patent is extended or adjusted under 35 U.S.C. 154(b) by 77 days.

(21) Appl. No.: 11/112,774

(22) Filed: Apr. 22, 2005

(65) Prior Publication Data

US 2006/0236464 A1 Oct. 26, 2006

(51) Int. Cl.
*A61G 7/057* (2006.01)

(52) U.S. Cl. ..... 5/713; 5/715; 5/710; 137/625.46

(58) Field of Classification Search ..... 5/710, 5/713, 715, 738; 137/625.46
See application file for complete search history.

(56) References Cited

U.S. PATENT DOCUMENTS 3,462,778 A * 8/1969 Whitney ..... 5/713
3,868,970 A * 3/1975 Ayers et al. ..... 137/625.46
4,542,547 A * 9/1985 Sato ..... 5/713
4,609,854 A 9/1986 Yamamoto et al.
4,637,083 A 1/1987 Goodwin
4,638,519 A 1/1987 Hess
4,644,597 A 2/1987 Walker
4,873,737 A * 10/1989 Savenije ..... 5/706
4,942,635 A 7/1990 Hargest et al.
4,953,247 A 9/1990 Hasty
4,967,431 A 11/1990 Hargest et al.
4,989,283 A 2/1991 Krouskop
5,008,965 A 4/1991 Vrzalik
5,020,176 A 6/1991 Dotson
5,029,352 A 7/1991 Hargest et al.
5,036,559 A 8/1991 Hargest
5,103,519 A 4/1992 Hasty
5,121,512 A 6/1992 Kaufmann
5,168,589 A 12/1992 Stroh et al.
5,201,780 A 4/1993 Dinsmoor, III et al.
5,267,364 A 12/1993 Volk
5,367,728 A 11/1994 Chang
5,511,260 A 4/1996 Dinsmoor, III et al.
5,539,943 A 7/1996 Romano
5,560,057 A 10/1996 Madsen et al.
5,619,764 A 4/1997 Lopau
5,623,736 A 4/1997 Soltani et al.
5,647,079 A 7/1997 Hakamiun et al.
5,655,239 A 8/1997 Caparon et al.
5,699,570 A 12/1997 Wilkinson et al.

(Continued)

OTHER PUBLICATIONS

Hill-Rom Services, Inc., ZoneAire Bed Systems Brochure (2002), available at http://www.hill-rom.com/usa/ZoneAire/Docs/CTG472_Zoneaire_Brochure.pdf.

(Continued)

*Primary Examiner*—Michael Trettel
(74) *Attorney, Agent, or Firm*—Holme Roberts & Owen LLP

(57) ABSTRACT

A system and method for controlling the flow of fluid for an inflatable mattress having multiple, non-interconnected inflatable chambers. Each inflatable chamber can be selectively inflated and deflated to vary the pressure exerted from the mattress surface to selected areas of a human body, thereby preventing the formation of decubitus ulcers.

73 Claims, 10 Drawing Sheets

U.S. PATENT DOCUMENTS

| | | | | |
|---|---|---|---|---|
| 5,740,573 | A | 4/1998 | Boyd | |
| 5,774,917 | A | 7/1998 | Liu | |
| 5,781,949 | A | 7/1998 | Weismiller et al. | |
| 5,787,531 | A | 8/1998 | Pepe | |
| 5,794,288 | A | 8/1998 | Soltani et al. | |
| 5,794,289 | A | 8/1998 | Wortman et al. | |
| 5,815,864 | A * | 10/1998 | Sloop | 5/706 |
| 5,815,865 | A | 10/1998 | Washburn et al. | |
| 5,918,336 | A | 7/1999 | Lee et al. | |
| 5,966,763 | A | 10/1999 | Thomas et al. | |
| 6,058,537 | A * | 5/2000 | Larson | 5/710 |
| 6,085,372 | A | 7/2000 | James et al. | |
| 6,098,223 | A | 8/2000 | Larson | |
| 6,152,176 | A | 11/2000 | Lin | |
| 6,154,907 | A * | 12/2000 | Cinquin | 5/713 |
| 6,192,537 | B1 | 2/2001 | Miki | |
| 6,212,718 | B1 | 4/2001 | Stolpmann et al. | |
| 6,253,402 | B1 | 7/2001 | Lin | |
| 6,266,833 | B1 | 7/2001 | Lin | |
| 6,351,862 | B1 | 3/2002 | Henley et al. | |
| 6,560,804 | B2 * | 5/2003 | Wise et al. | 5/713 |
| 6,591,437 | B1 | 7/2003 | Phillips | |
| 6,681,427 | B2 | 1/2004 | Anderson et al. | |
| 6,687,935 | B2 | 2/2004 | Reeder et al. | |
| 6,694,555 | B2 | 2/2004 | Soltani et al. | |
| 6,943,694 | B1 * | 9/2005 | Ellis | 340/666 |
| 2004/0158927 | A1 | 8/2004 | Soltani et al. | |

OTHER PUBLICATIONS

PCT International Search Report - International Appl. No. PCT/USS06/14978 - Applicant's/Agent's File Reference 49696-01011.
PCT Written Opinion of the International Searching Authority.

* cited by examiner

MULTICOMPARTMENTED AIR MATTRESS

BACKGROUND OF THE INVENTION

1. The Field of the Invention

The present invention relates generally to an inflatable mattress and, more specifically, to a mattress having multiple, fluidly-unconnected chambers that can be selectively inflated and deflated to increase and decrease the pressure exerted from positions on the mattress surface on various points of contact with the human body.

2. The Relevant Technology

There is evidence that decubitus ulcers, otherwise known as pressure sores or bedsores, may develop when a bed-ridden person is not able to move. For example, people who are unconscious, unable to sense pain, paralyzed or otherwise unable to move can remain in the same location fostering the development of the bedsores. Bedsores are ugly, generally regarded as painful and typically debilitating. To reduce the incidence of bed sores, people in attendance to the bed-ridden person need to move or rotate the bed ridden person on a regular basis and in turn vary the parts of the body that are exposed to the pressure and reduce the risk of developing bed sores. Bed sores can be found on people/patients in hospitals, nursing homes and in homes under home care. Bedsores can lead to additional medical complications, including bone and blood infections, infectious arthritis, penetrating holes below the wound that burrow into bone or deeper tissues, and scar carcinoma, a form of cancer that develops in scar tissue.

Bedsores generally form at points of pressure, where the weight of the patient's body presses the skin against the firm surface of the bed. The skin's blood supply is believed to be interrupted or reduced by the pressure in turn causing injury to skin cells which can cause them to die. Unless the pressure is periodically is relieved to allow full blood flow to the pressed areas of the skin, the skin cells in the area start to die leading to ulcerations as the body seeks to deal with the cells. The ulcerations can grow into notable bed sores some in excess of the area of a quarter or half dollar. To allow blood to flow to the areas of restriction and reduce the risk of sores, attending personnel are typically tasked to regularly turn the patients. However, turning of patients as tasked does not always happen for reasons not pertinent here.

Bedsores are commonly found on or near the tail bone area, hips, back, elbows, heels and ankles. They can become deep, extending into the muscle. Muscle is even more prone to severe injury from pressure than skin. This means that mild injury to the skin may cover a deeper, more pronounced injury to muscle. Bedsores are extremely difficult to heal, unnecessary and can be prevented. It is much easier and cheaper to prevent a bed sore than to try and heal a bedsore.

Inflatable mattresses that are seen in the literature appear to be and are believed to be difficult to operate, expensive, and unreliable. In turn, it is understood that such have enjoyed only limited acceptance. An inflatable mattress that is easily usable for a patient or hospital bed that is reliable and easy to operate is not known. An inflatable mattress that varies the pressure in separate cells under different parts of the body and that accurately and promptly operates to maintain the pressure and then vary it in accordance with individual or preprogrammed instructions is also not known.

BRIEF SUMMARY OF THE INVENTION

A mattress system of the present invention includes multiple inflatable chambers, a pump, a valve assembly, a source of liquid (including gases like air), a sensor to detect the position of the inflatable chambers, a controller and interconnecting conduits. The multiple inflatable chambers are selectively inflatable and deflatable to vary the points of contact between the mattress surface and the patient's body. The inflatable mattress system of the present invention alternates, by the use of inflatable cells, the amount and location inflatable chamber pressure, thereby regulating the amount and location of mattress surface contact with a patient's body for a pre-selected period of time. Complications associated with pressure sores that result from constant contact between parts of the mattress surface and the body are thereby significantly reduced if not eliminated.

A system and method for selectively inflating and/or deflating a plurality of inflatable chambers of a mattress system is provided. The system includes a first plurality of inflatable chambers, each of which has at least one wall member forming an interior volume. The wall member is made from a flexible material selected to retain fluid. Each of the first plurality of inflatable chambers have a chamber connector for fluid communication with the interior volume. The wall member is deflectable between a first inflated position and a second inflated position that is different from the first inflated position.

The system and method also includes a number of deflectable resistors that predictably vary their respective electrical resistance upon deflection from a first configuration to a second configuration when applying an electrical signal thereto. Each of the deflectable resistors are attached to a wall member of an inflatable chamber to deflect therewith upon movement between the first inflated position and the second inflated position. The deflectable resistor generates a deflection signal reflective of said movement. A fluid source is provided for supplying a fluid under pressure into each interior volume of the first plurality of inflatable chambers.

The system and method further includes a first conduit means connected to the chamber connector for communicating fluid to and from the interior volume and a second conduit means connected to the fluid source for communicating fluid to and from the fluid source. A discharge means communicates fluid away from the inflatable mattress system from the interior volume. A valve is connected to the first conduit means, the second conduit means and the discharge means. The valve operates between a first position in which the valve places the first conduit means in communication with the second conduit means for supplying fluid from the fluid source to the interior volume and a second position in which the valve places the first conduit means in fluid communication with the discharge means. A controller is connected to each of the deflectable resistors for supplying an electrical signal and for receiving the deflection signal. The controller is connected to the valve and is configured to generate and supply operating commands for operating the valve between the first position and the second position.

In another embodiment, the inflatable mattress has a processor that is communicatively coupled to a controller. The processor has computer-executable instructions for performing a computer process for receiving a deflection signal, deriving an amount of movement from the deflection signal and directing a controller to deliver operating commands.

In another preferred embodiment, the valve is a valve assembly having a valve housing with an inlet for connecting said valve assembly to said fluid source. The valve assembly also includes a first valve plate having a first aperture and a second aperture. A second valve plate is also provided that has a plurality of outlet apertures. The second valve plate is coupled to the valve housing forming a fluid chamber. The outlet apertures are disposed at locations about the second valve plate so that the outlet apertures align with either the first aperture or the second aperture. A drive mechanism is connected to the first valve plate to rotate the first valve plate relative to the second valve plate.

In yet another preferred embodiment, the valve assembly has a three-way valve. The three-way valve is coupled to the fluid source and to the atmosphere. The three-way valve is configured for supplying the inflatable chambers with fluid from the fluid source and discharging the fluid from the inflatable chambers into the atmosphere.

In still another preferred embodiment, the valve assembly further comprises a pressure sensor for monitoring fluid pressure in each inflatable chamber. The pressure sensor takes a pressure reading within the inflatable chambers and transmits the pressure reading to a controller.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made in detail to the preferred embodiments of the present invention, examples of which are illustrated in the accompanying drawings. The various exemplary embodiments provide an inflatable mattress having multiple, fluidly isolated inflatable chambers that can be selectively inflated and deflated to increase and decrease the pressure exerted from various points of the mattress surface on a human body.

Figure 1:
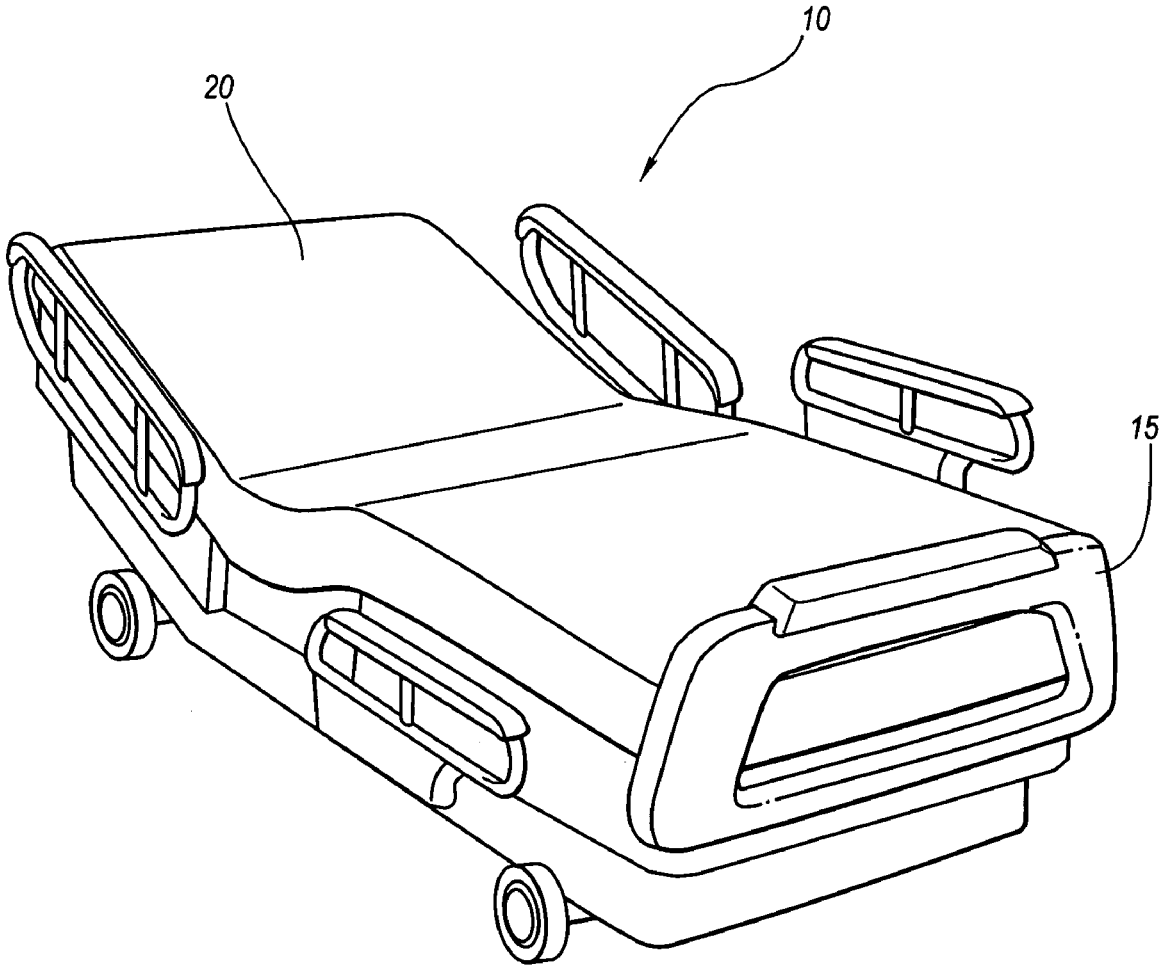
FIG. 1 illustrates a hospital bed apparatus using the inflatable mattress system of the present invention.

Referring to FIG. 1, the inflatable mattress of a first embodiment is displayed in a typical hospital bed apparatus 10. The two basic components of hospital bed apparatus 10 include a conventional hospital bed 15 and an inflatable mattress system 20 embodying the present invention. The inflatable mattress system 20 may be discussed here for use with a conventional hospital bed. However, any number of commercial applications that incorporate the mattress system of the present invention are possible including home, hospice, hotel, mobile home and RV to name a few.

Figure 2:
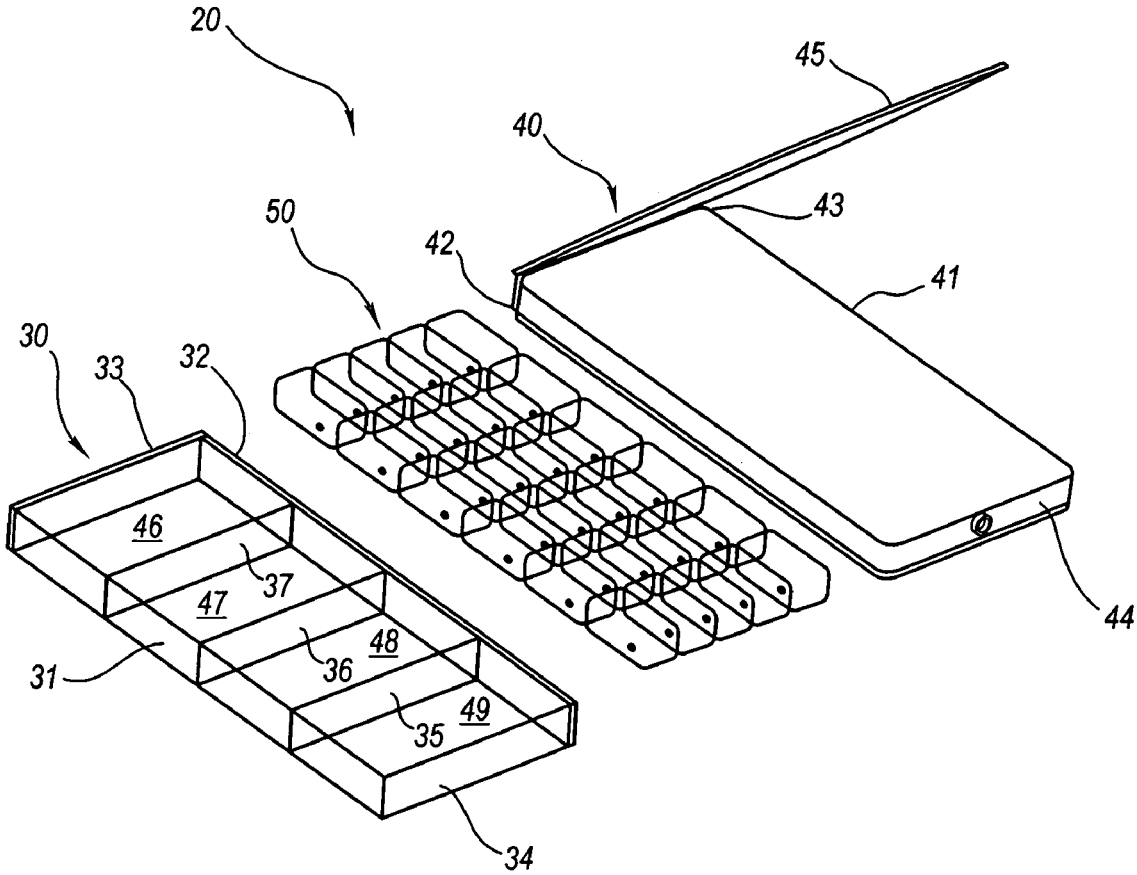
FIG. 2 illustrates an exploded perspective view of the inflatable mattress system.

Referring now to FIG. 2, an exploded structure of inflatable mattress system 20 is illustrated. Inflatable chamber enclosure 30 is a generally rectangular element having side walls 31, 32, top end wall 33, bottom end wall 34 and inflatable chamber dividers 35, 36 37. Inflatable chamber dividers 35, 36 and 37 are disposed within inflatable chamber enclosure 30 at various locations to form the containment areas for a plurality of mattress cells or inflatable chambers 50.

Inflatable chamber dividers 35, 36, 37 are placed generally at locations within enclosure 30 corresponding to the particular shape and size of the plurality of inflatable chambers 50 in a row or grouping. For example, interior region 46 of mattress system 20 is defined between top end wall 33, a portion of side wall 31, a portion of side wall 32 and cell divider 37. As such, a grouping of plurality of mattress cells or inflatable chambers 50 would be located within the interior region 46 of mattress system 20. Interior regions 47, 48, 49 are formed in a similar manner as interior region 46.

Inflatable chamber cover 40 is generally a rectangular element having side walls 41, 42, top end wall 43, bottom end wall 44 and a removable lid 45. Removable lid 45 is secured to top end wall 43 by any conventional means appropriate for the material used to manufacture inflatable chamber cover 40. For example, if inflatable chamber cover 40 is manufactured using a fabric such as cotton, conventional sewing stitches may be used to secure removable lid 45 to top end wall 43. Removable lid 45 is then secured to side walls 41, 42 and bottom end wall 43 with suitable fasteners such a zipper, snaps, or other coupling mechanism. (not shown).

A plurality of inflatable chambers 50, designed to support the weight of a human body, are positioned within inflatable chamber enclosure 30. In the illustrated embodiment, the mattress structure of inflatable mattress system 20 is sized as a twin mattress for use in a typical hospital bed. However, any mattress size (e.g. king, queen, or full) may be manufactured using the inflatable multi-cell design described herein without departing from the intended scope and spirit of the invention.

Inflatable chamber cover 40 is adapted to fit together with inflatable chamber enclosure 30. The combination of inflatable chamber cover 40, inflatable chamber enclosure 30 and plurality of inflatable chambers 50 forms the overall structure of the inflatable mattress. Removable lid 45 may be folded back to expose the plurality of inflatable chambers 50. Thus, any inflatable chamber 50 within inflatable mattress system 20 may be easily replaced or repaired without having to compromise the overall structural integrity of mattress system 20. The structure and design of inflatable chambers 50 are an important aspect of the present invention, and therefore, are described in greater detail in subsequent paragraphs.

Figure 3:
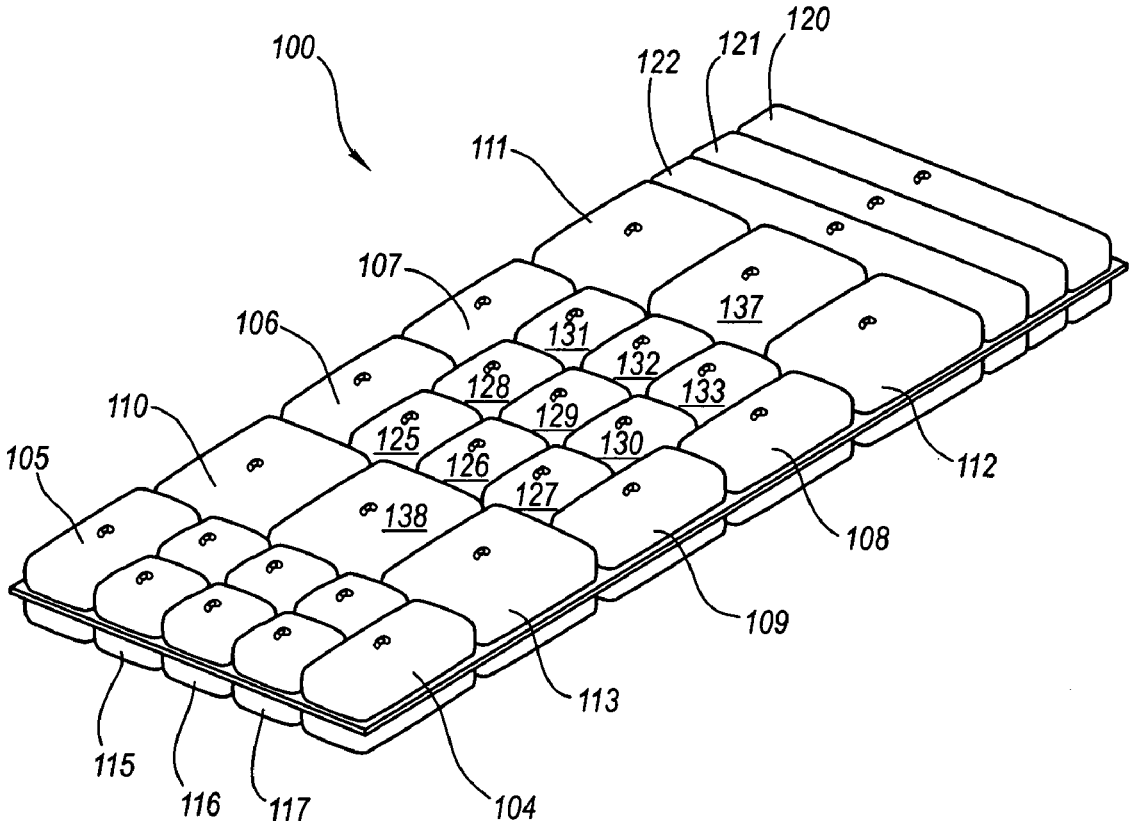
FIG. 3 illustrates an alternate arrangement of an inflatable mattress system using several different sized inflatable chambers.

Referring now to FIG. 3, one embodiment of inflatable mattress system 100 having multiple cells, or inflatable chambers, of differing sizes arranged in an advantageous manner to minimize the occurrence of bedsores in a patient is illustrated. In the illustrated embodiment, a group of elongated inflatable chambers 120, 121, 122 are positioned where an individual's head would typically rest on the mattress surface. The elongated inflatable chambers 120, 121, 122 are sized to provide maximum comfort to an individual's head and neck area. A group of large inflatable chambers 110, 111, 112, 113, 137, 138 are located where an individual's shoulders and legs would typically be located on the mattress. The large inflatable chambers 110, 111, 112, 113, 137, 138 are sized to provide a comfortable cushioned surface for large areas of the human body not susceptible to the formation of bedsores.

In a preferred construction, a group of small inflatable chambers 115, 116, 117, 134, 135, 136 are positioned where an individual's ankles and a group of small inflatable 125, 126, 127, 128, 129, 130, 131, 132, 133 are positioned where an individual's hips would typically be located on the surface of a mattress. Selective inflation and deflation of the illustrated small inflatable chambers provides a variation of the pressure at points of contact between the mattress surface and the body at the most common places for the development of bedsores on a bed-ridden individual. Since the inflatable chambers are small, alternating the amount of pressure from even 1.0 to 1.1 psi can significantly vary the pressure points so as to change the points of contact between the mattress surface and the hips and ankles of an individual. A group of medium inflatable chambers 104, 105, 106, 107, 108, 109 are located adjacent the group of small inflatable chambers. The medium inflatable chambers provide a measure of support for a grouping of small inflatable chambers.

In a preferred embodiment, the inflatable chambers are sized and placed according to the average weight and size of a typical human body. In other embodiments, inflatable chambers may be larger sized to accommodate the weight of a very large person or smaller sized to accommodate the weight of a baby or child. Preferably, elongated inflatable chambers 120, 121, 122 are sized in a range of approximately 36.0 inches by 3.7 inches to 37 inches by 4.7 inches, and are preferably 36.5 inches by 4.2 inches. Large inflatable chambers 110, 111, 112, 113 are sized in a range of approximately 13.0 inches by 11.3 inches to 14.0 inches by 12.3 inches, and are preferably 12.5 inches by 10.8 inches. Small inflatable chambers 115, 116, 117 are sized in a range of approximately 8.3 inches by 6.4 inches to 9.3 inches by 7.4 inches, and are preferably 8.8 inches by 6.9 inches. Medium inflatable chambers 104, 105, 106, 107, 108, 109 are sized in a range of approximately 13.0 inches by 6.4 inches to 14.0 inches by 7.4 inches, and are preferably 12.5 inches by 6.9 inches. Preferably, elongated inflatable chambers, large inflatable chambers, small inflatable chambers and medium inflatable chambers are approximately 3.0 inches thick.

The inflatable chambers illustrated in FIG. 3 are not fluidly connected, so each inflatable chamber may be individually inflated and deflated. Such an arrangement also allows for easy removal and replacement of any worn or damaged cells.

Figure 4:
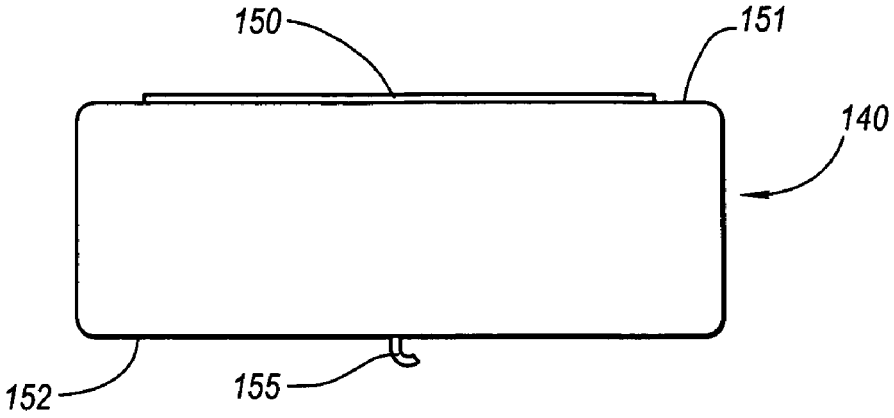
FIG. 4 illustrates a side view of an individual inflatable chamber.
Figure 5:
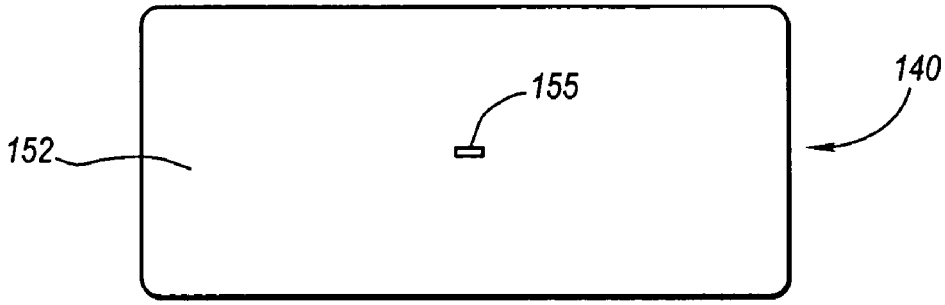
FIG. 5 illustrates a bottom view of an individual inflatable chamber showing a fitting.
Figure 6:
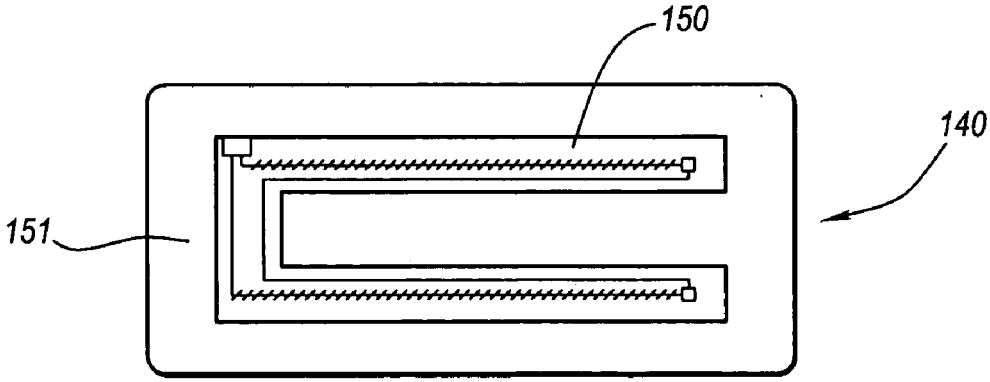
FIG. 6 illustrates a top view of an individual inflatable chamber showing the placement of a deflectable resistor.

FIGS. 4, 5 and 6 illustrate, respectively, a side view, a bottom view and a top view of inflatable chamber 140. Inflatable chamber 140 has a top surface 151 and a bottom surface 152. In the illustrated embodiment, inflatable chamber 140 is shown as substantially rectangular. However, inflatable chambers of varying shapes such as circular, spherical, cylindrical, toroidal, ovular, triangular could be used as well.

Inflatable chamber 140 is constructed of any substantially non-porous, flexible material. For example, inflatable chamber 140 may be manufactured of a vinyl material, the thickness of the material falling within a range from about 0.015 inches to about 0.04 inches, and preferably, is 0.02 inches. Any similar material may be used. A suitable material should be weldable and sealable to create an interior volume in the interior of the inflatable chamber 140, such that a fluid may be introduced to inflate the cell but the fluid does not escape. In one preferred embodiment, one surface of the inflatable chamber 140 is constructed of the non-porous, flexible material. However, one or more of the surfaces of the inflatable chamber 140 may be manufactured of the flexible material and the remaining surfaces may be manufactured of a different material.

The top surface 151 is relatively smooth and adapted to support at least a portion of the weight of an individual positioned on the surface of the inflatable mattress system 100 of FIG. 3. The bottom surface 152 has a chamber connector 155 that either introduces fluid into or releases fluid from the inflatable chamber 140. Chamber connector 155 may be positioned on any surface of inflatable chamber 140 and is configured to connect to a conduit means for communicating fluid to and from the interior volume. In the illustrated embodiment, chamber connector 155 is an aperture in inflatable chamber 140 and a fitting. However, chamber connector 155 may be any element suitable for fluidly communicating between the interior volume of inflatable chamber 140 and any element that supplies, releases or measures fluid such as, for example, a valve, a connector, a PVC or metal conduit, a female or male adapter or a liquid tight flexible conduit and fitting.

A deflectable resistor 150 is secured to a surface of inflatable chamber 140 to detect the presence or absence of a pressure point, such as a patient's weight, on a particular inflatable chamber. In a preferred embodiment, deflectable resistor 150 is secured to the top surface 151. Deflectable resistor 150 consists of a coated substrate that changes in electrical conductivity as it is bent. The change from a first configuration to a second configuration results in a change in the inflatable chamber 140 from a first inflated position to a second inflated position, which varies the resistance of the deflectable resistor 150 in a predictable way. At any time, the resistance may be measured by applying an electrical signal such as a voltage or a current to the deflectable resistor 150. Connections may be made to deflectable resistor 150 to capture the deflection information so as to determine the amount of bending or movement that occurs on top surface 151 between a first inflated position and a second inflated position, referred to herein as a deflection signal that is reflective of the movement.

A suitable deflectable resistor for purposes of detecting a pressure point on the surface of inflatable chamber 140 is a Bend Sensor® potentiometer manufactured by Flex Point Sensor System, Inc., also described in U.S. Pat. Nos. 5,157,372 and 5,583,476, the disclosure of which is hereby incorporated by reference for all purposes. Deflectable resistor 150 is affixed to the surface of inflatable chamber 140 by any suitable means, and preferably is affixed by a pressure sensitive adhesive that adheres to top surface 151 without affecting the integrity of the material used to manufacture deflectable resistor 150.

Figure 7:
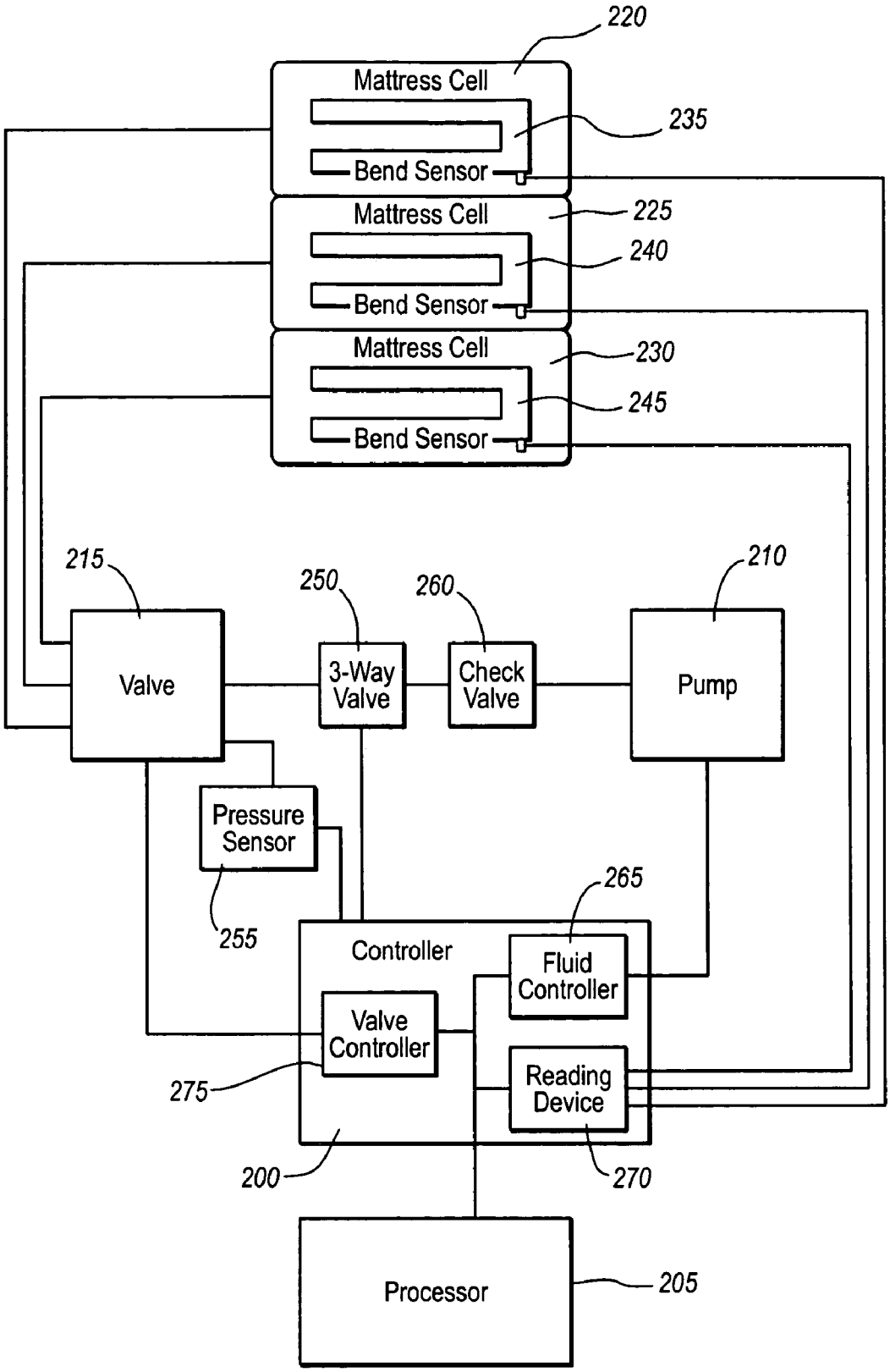
FIG. 7 is a block diagram illustrating the electrical and mechanical elements for controlling the operation of the inflatable mattress system.

Referring now to FIG. 7, a block diagram illustrating the electrical and mechanical elements for controlling the operation of the inflatable mattress system of the present invention is shown. In the illustrated embodiment, a controller 200 is communicatively coupled to a processor 205 having computer instructions embodied therein, the combination controlling the overall operation of the inflatable mattress system. Controller 205 is communicatively coupled to a fluid source 210, a valve assembly 215 and a plurality of deflectable resistors 235, 240, 245, thereby allowing for the selective introduction, discharge and measurement of a fluid within the inflatable chambers 220, 225, 230 based upon a deflection signal received from the deflectable resistors. Although three inflatable chambers are illustrated and described with respect to FIG. 7, any number of inflatable chambers may be used depending upon the particular needs of the inflatable mattress system, such as the potential weight of a human body that the inflatable mattress system may support.

In the particular device illustrated, controller 200 is comprised of valve controller 275, fluid controller 265 and reading device 270. In alternate embodiments, controller 200 may be a mechanical or electrical device that incorporates the functions and operations of valve controller 275, fluid controller 265 and reading device 270 in either a single device or multiple devices. Valve controller 275 controls the operation of valve assembly 215 by sending a series of signals to the valve assembly 215 to perform various mechanical operations, such as selecting a particular inflatable chamber for inflation, deflation or measurement. Fluid controller 265 controls the strength and duration of the flow of fluid from fluid source 210 to any one of inflatable chambers 220, 225, 230 by providing a signal to fluid source 210 to initiate the introduction of fluid to inflate a selected inflatable chamber. Reading device 270 receives a deflection signal from deflectable resistors 235, 240, 245 to determine the location and amount of an individual's weight that is located on inflatable chambers 220, 225, 230.

In a preferred embodiment, controller 200 is embodied in any suitable programmable integrated circuit such as M30262 manufactured by Renesas. However, any suitable programmable integrated circuit may be used to supply operating commands that control the operation of valve assembly 215 and fluid source 210, as well as receive deflection measurements from the surface of inflatable chambers 220, 225, 230 and pressure measurements from within the respective interior volume of inflatable chambers 220, 225, 230. For example, controller 200 may be embodied in an ASIC, or similar application specific integrated circuit.

Controller 200 is also coupled to valve assembly 215 through a pressure sensor 255 for reading the pressure within inflatable chambers 220, 225, 230. Pressure sensor 255 is typically a pressure transducer capable of measuring the amount of pressure within an inflatable chamber when such as request is issued by either controller 200 or processor 205. However, any suitable pressure measuring device may be used. In operation, controller 200 is instructed to retrieve a pressure reading within a particular inflatable chamber, for example, inflatable chamber 220. Valve assembly 215, via information from valve controller 275, selects inflatable chamber 220 for a reading. Once chamber 220 is chosen, the pressure reading is taken by pressure sensor 255 and relayed to processor 205 via controller 200.

Processor 205 preferably comprises any computer processor capable of executing a series of instructions to access data from controller 200 and issue commands to controller 200. For example, processor 205 may contain instructions for selecting certain inflatable chambers for inflation or deflation based on deflection information received from deflectable resistors 235, 240, 245. Processor 205 may also contain instructions for randomly selecting inflatable chambers 220, 225, 230 for inflation and deflation in a particular pattern that provides varying pressure points on the skin of an individual's body, thereby preventing the formation of bedsores.

In the illustrated embodiment, fluid source 210 is coupled via a fluid passage or conduit to valve assembly 215 through a three-way valve 250 and a check valve 260. However, fluid source 210 may be coupled directly to valve assembly 215 using a conduit or fluid source coupled to the valve assembly 215 through any number of intervening devices such as a flow meter. Three-way valve 250 allows fluid source 210 to introduce fluid into inflatable chambers 220, 225, 230 through valve assembly 215. In addition, three-way valve 250 is coupled to the atmosphere through a fluid discharge outlet such that fluid may be removed from inflatable chambers 220, 225, 230 through valve assembly 215. Check valve 260 preferably has a crack pressure of 0.15 psi, which prevents back flow through the fluid source 210. Fluid source 210 is preferably a pump that is sized to provide at least ½ pound per square inch of pressure in inflatable chambers 220, 225, 230, such as a 110 VAC model # DDL15B-101, 23 L/m linear diaphragm pump manufactured by Gast that outputs approximately 5 pounds per square inch of pressure, however, any suitable fluid source may be used that is sized in accordance with the particular requirements of the inflatable mattress system.

Valve assembly 215 is fluidly coupled to inflatable chambers 220, 225, 230. In operation and with reference to an operating command received from controller 200, valve assembly 215 selects a particular inflatable chamber for inflation or deflation. In inflation mode, valve assembly 215 is operational to introduce fluid from fluid source 210 into a selected inflatable chamber. In deflation mode, valve assembly 215 releases fluid into the atmosphere from a selected inflatable chamber using three-way valve 250 as a fluid discharge outlet. Valve assembly 215 may be any suitable element for selectively supplying fluid from a fluid source 210 or communicating fluid away from a mattress system. One particular embodiment of a valve assembly 215 is described in greater detail with reference to FIGS. 8–15.

Figure 8:
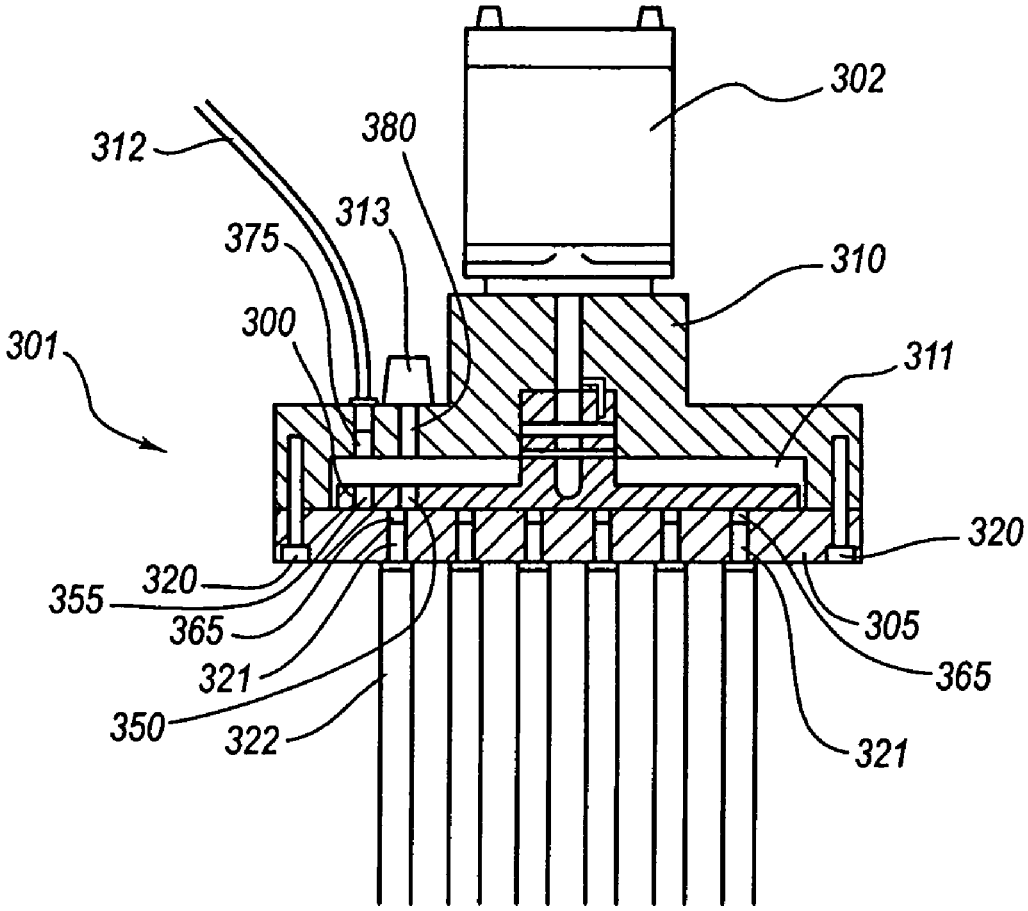
FIG. 8 illustrates a front view of the valve assembly.

Referring now to FIG. 8, valve assembly 301 generally includes a first valve plate 300, a second valve plate 305, a valve housing 310 and a drive mechanism 302. Valve housing 310 is secured to second valve plate 305 using a plurality of securing apparatus 320. A fluid chamber 311 is formed interior to the valve assembly 301, resulting from a surface of second valve plate 305 and an interior surface of valve housing 310.

Valve housing 310 has two housing apertures. A first housing aperture 375 is connected to a conduit, or passage, 312, which is fluidly connected to three-way valve 250 illustrated in FIG. 7. Depending upon the setting of three-way valve 250, fluid may be introduced into or removed from fluid chamber 311 through conduit 312. Valve housing 310 also has a second housing aperture 380 coupled to an optical sensor 313 that aligns first valve plate 300 with second valve plate 305 of valve assembly 301.

First valve plate 300 is located within fluid chamber 311. First valve plate 300 is coupled to a drive mechanism 302 that imparts rotational movement to first valve plate 300 relative to second valve plate 305. Second valve plate 305 has a plurality of outlet apertures 365 that are fluidly connected to each inflatable chamber. Each outlet aperture 365 is coupled to a conduit, or passage, 322 using a conduit coupler 321. Preferably, conduit coupler 321 is a ¼ inch barbed fitting, however, any suitable coupling means may be used that forms an air tight seal between conduit 322 and the outlet aperture 365 of second valve plate 305.

Figure 9:
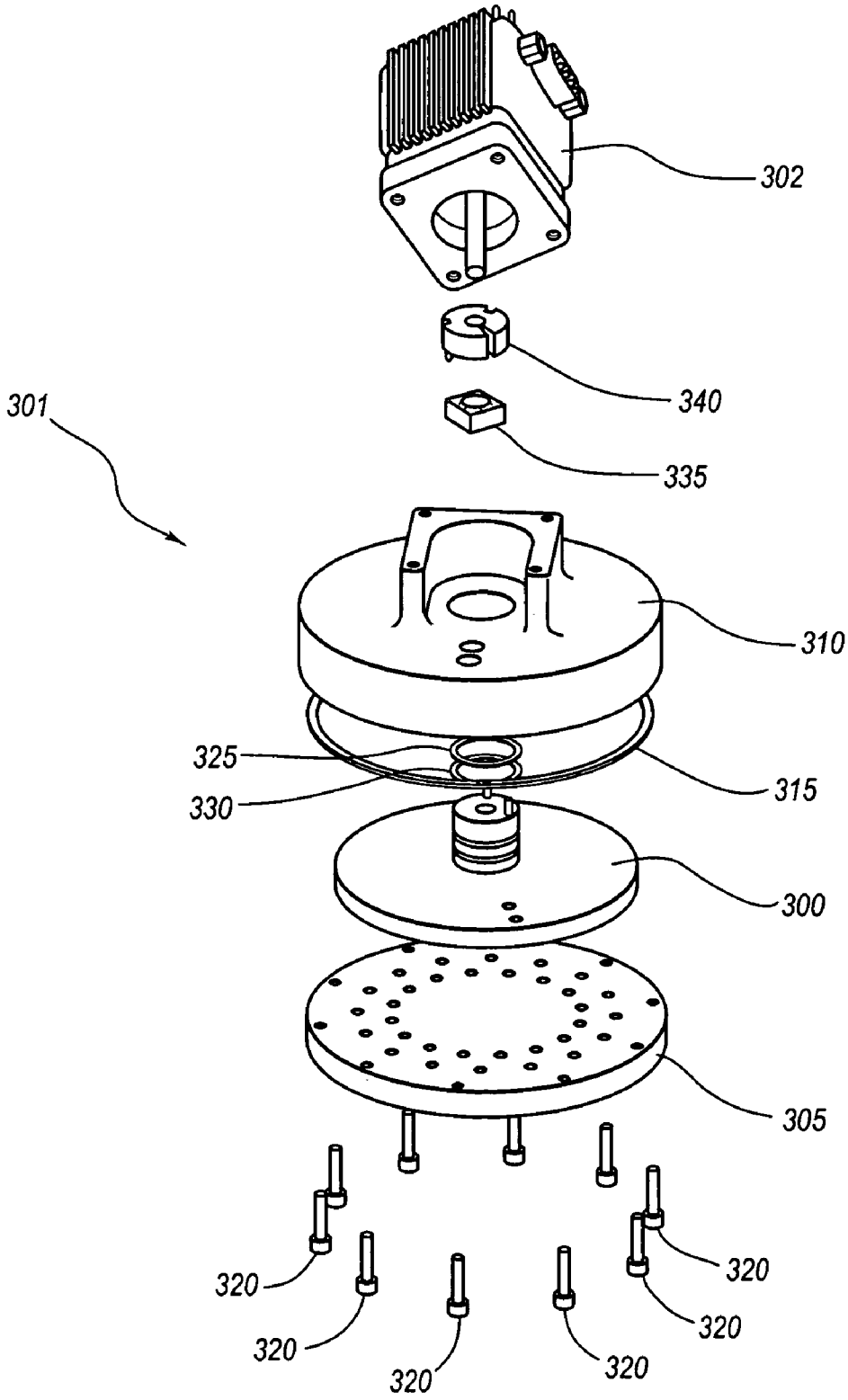
FIG. 9 illustrates an exploded perspective view of the elements of the valve assembly.

FIG. 9 illustrates an exploded view of valve assembly 301. As shown, valve assembly 301 also includes a plurality of O-rings 325, 330, a seal 315 and a plurality of securing apparatus 320 for connecting second valve plate 305 to valve housing 310. Valve housing 310 is configured to receive pinhole disk coupling 335 and pinhole hub coupling 340 and drive mechanism 302 for imparting rotational movement to first valve plate 300 relative to second valve plate 305 in response to information from controller 200 illustrated and described with respect to FIG. 5. Pinhole hub coupling 340 couples the shaft of the drive mechanism 302 to first valve plate 300. The shaft of drive mechanism 302 passes through pinhole disk coupling 335 such that coupling 335 keeps the shaft of drive mechanism 302 true so as to keep first valve plate 300 from pinching and binding. Preferably, the drive mechanism 302 is a stepper motor manufactured by Oriental Motor, however, any suitable stepper motor may be used in accordance with the requirements of inflatable mattress system of the present invention.

Figure 10:
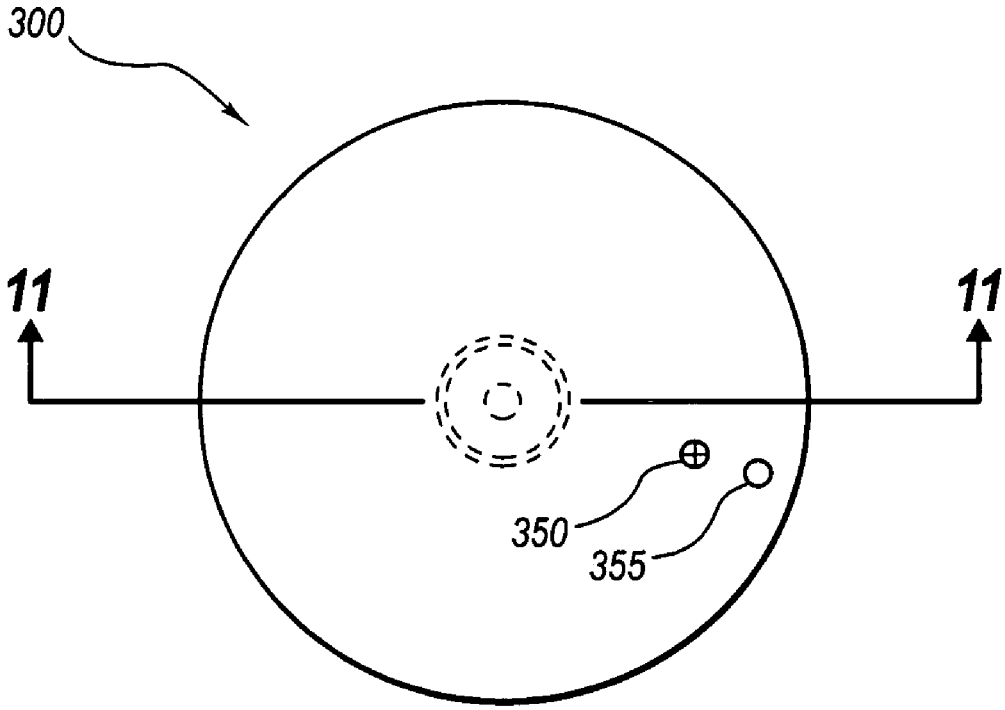
FIG. 10 illustrates a top view of the first valve plate of the valve assembly.
Figure 11:
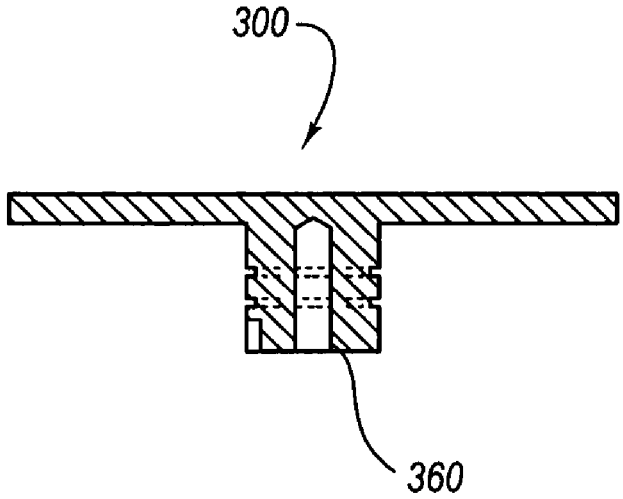
FIG. 11 illustrates a side view of the first valve plate of the valve assembly.

FIGS. 10 and 11 illustrate, respectively, a top view and a side view of first valve plate 300. First valve plate 300 has a first aperture 350 and a second aperture 355 disposed on and protruding through the surface of the valve plate 300. First aperture 350 and second aperture 355 assist in imparting fluid from fluid source 210 into inflatable chambers 220, 225, 230 of FIG. 7. First aperture 350 may also be used to align valve assembly 301 prior to operation. First valve plate 300 has an integral coupling means 360 for connecting the valve plate 300 to a drive mechanism 302 using pinhole hub coupling 340, illustrated in FIG. 9.

Figure 12:
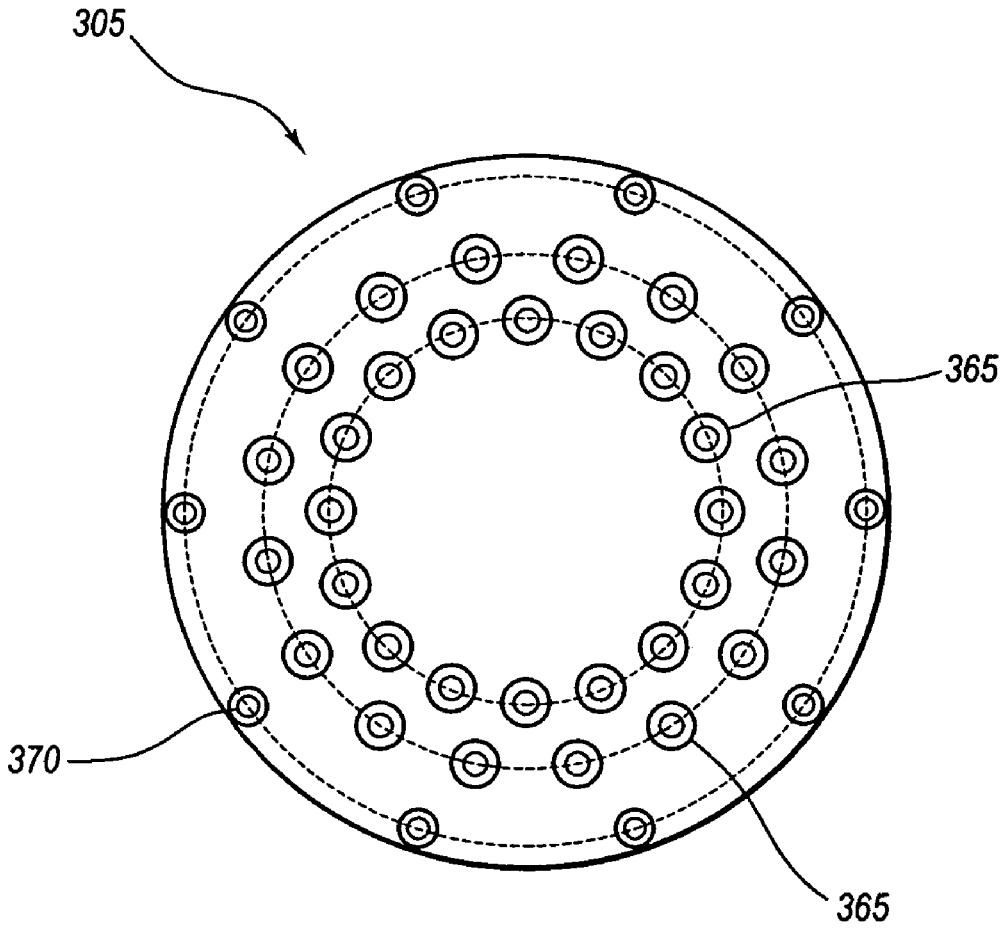
FIG. 12 illustrates a top view of the second valve plate of the valve assembly.
Figure 13:
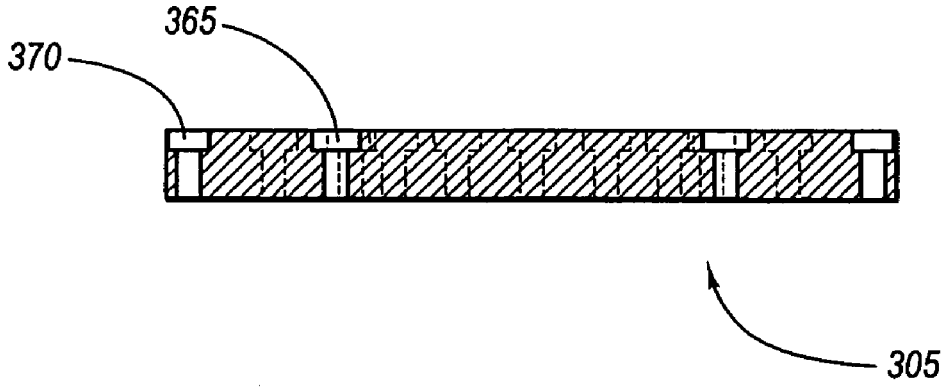
FIG. 13 illustrates a side view of the second valve plate of the valve assembly.

Referring now to FIGS. 12 and 13, a top view and a side view of second valve plate 305 are illustrated. Second valve plate 305 has a plurality of outlet apertures 365 disposed about and protruding through the surface of the plate. In the illustrated embodiment, there are thirty-two (32) outlet apertures 365 disposed on second valve plate 305. Two outlet apertures are unused. Fifteen outlet apertures 365 are arranged substantially equal spaced about the second valve plate 305 about a first radius from the center point of the plate and fifteen outlet apertures 365 are arranged substantially equal spaced about the second valve plate 305 about a second radius from the center point of the second valve plate 305. Outlet apertures 365 are coupled to a plurality of conduits 322 of FIG. 8, and each conduit 322 is coupled to a chamber connector 155 of an inflatable chamber 140, seen in FIGS. 4–5, so that an outlet aperture 365 is coupled to each inflatable chamber 140 within the inflatable mattress system.

In operation, first valve plate 300 rotates relative to second valve plate 305 using a drive mechanism 302. Typically, first valve plate 300 is disk shaped and second valve plate 305 is shaped to substantially match the shape of first valve plate 300. Either first aperture 350 or second aperture 355 on first valve plate 300 aligns with an outlet aperture 365 on second valve plate 305. Each outlet aperture 365 is fluidly connected to a corresponding inflatable chamber 220, for example, in the inflatable mattress system. In this way, a fluid path is selectively established to either impart fluid from a fluid source 210 into a selected inflatable chamber 220 or release fluid from a selected inflatable chamber into the environment.

Drive mechanism 302, typically a stepper motor, imparts rotational movement to first valve plate 300, thereby rotating first valve plate 300 relative to second valve plate 305. Unlike standard motors, a stepper motor moves in discrete increments to position first plate 300 relative to second plate 305. Such controlled movement positions either first aperture 350 or second aperture 355 of first valve plate 300 over the selected outlet aperture 365 of second valve plate 305 so as to allow a single inflatable chamber to be inflated or deflated without affecting the integrity of any other inflatable chamber.

In the illustrated embodiment, second drive plate 305 has thirty-two (32) outlet apertures 365. Two of the apertures are not used for either an inflate operation or deflate operation, but instead are used for an alignment operation. The remaining thirty (30) apertures 365 are each coupled to a particular inflatable chamber and, therefore, are used in either an inflate operation or deflate operation. Controller 200 is pre-programmed to recognize which outlet aperture 365 is coupled to which inflatable chamber 220, 225, 230, for example, in the inflatable mattress system. Controller 200 may therefore receive information from processor 205 and select a particular outlet aperture 365 coupled to a particular inflatable chamber 220, for example, and thereafter perform an inflate operation or deflate operation or measure the pressure within the interior volume of the selected inflatable chamber 220.

Drive mechanism 302 is adapted to step first valve plate 300 through all thirty-two (32) outlet apertures 365, thereby aligning either first aperture 350 or second aperture 355 with a selected outlet aperture 365 in response to a signal from controller 200. Drive mechanism 302 receives a signal from controller 200 and steps first valve plate 300 to the appropriate outlet aperture 365 on second valve plate 305 corresponding to the selected inflatable chamber 220.

Figure 14:
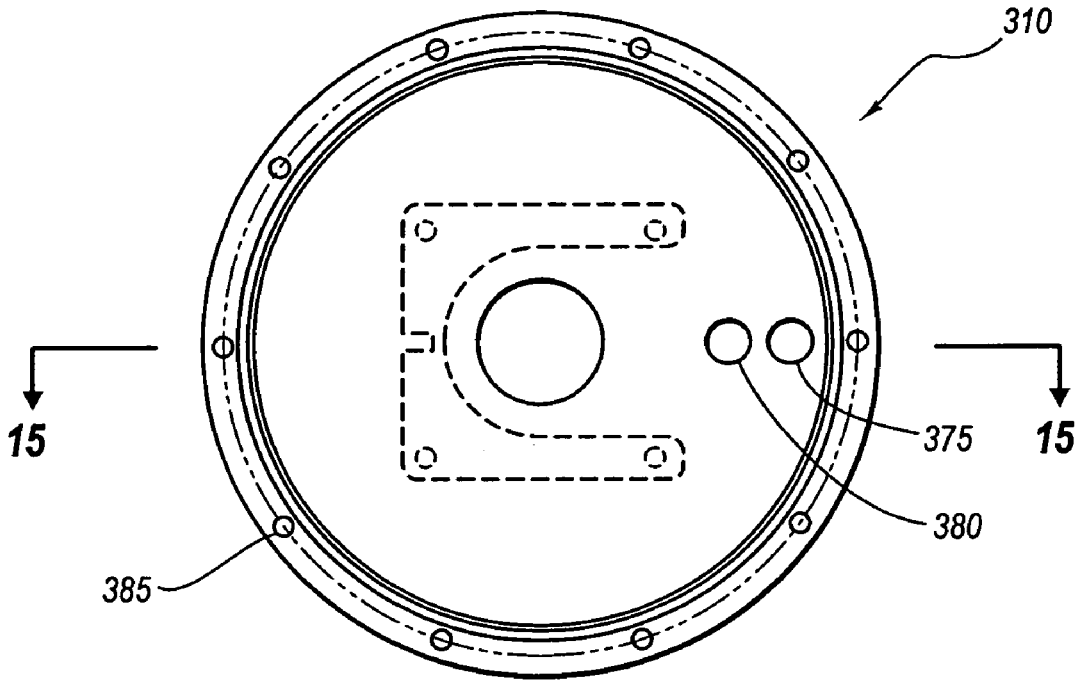
FIG. 14 illustrates a top view of the valve housing of the valve assembly.
Figure 15:
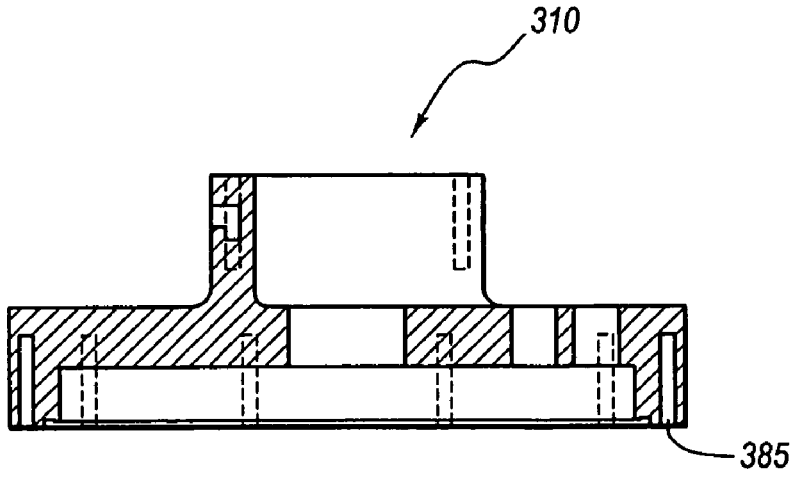
FIG. 15 illustrates a side view of the valve housing of the valve assembly.

FIGS. 14 and 15 illustrate, respectively, a top view and a side view of valve housing 310. Valve housing 310 has a first housing aperture 375 for coupling a conduit 312, seen in FIG. 8, leading from a fluid source 210 and the atmosphere, to valve assembly 301. Valve housing 310 has a second housing aperture 380 for coupling optical sensor 313. First housing aperture 375 is coupled to fluid source 210 and to the atmosphere through three-way valve 250. In this way, fluid maybe introduced from fluid source 210 through both three-way valve 250, conduit 312, and first housing aperture 375 into the fluid chamber 311 of valve assembly 301, ultimately finding its way into any one of inflatable chambers 220, 225, 230. Similarly, fluid may be released from fluid chamber 311 of valve assembly 301 into the atmosphere through three-way valve 250.

With reference to certain reference numerals in FIGS. 7–15, the operation and interconnectivity of valve assembly 215, controller 200, inflatable chamber 230, deflectable resistors 235, 240, 245 and fluid source 210, as an example, will be described in detail illustrating an inflatable chamber selection operation, an inflatable chamber inflation operation, an inflatable chamber deflation operation, an inflatable chambers pressure measurement operation and an inflatable chamber deflection reading operation.

Assembly valve 215 is operational to select an inflatable chamber 220, for example, and then either introduce fluid into the selected inflatable chamber 230 or release fluid from the selected inflatable chamber 230. In this manner, a single inflatable chamber 230 can be inflated and/or deflated in response to information provided from a controller 200 coupled to a processor 205. In addition, once a particular inflatable chamber 230 is selected, the pressure in the inflatable chamber may be read and recorded by a pressure sensor 255 coupled to the controller 200. In addition, assembly valve 215 provides an alignment feature that squares-up the drive mechanism 302 of the valve assembly 301 before the valve assembly 301 is operational so that the drive mechanism 302 does not pinch and bind.

For an inflatable chamber selection operation, controller 200 establishes that a particular inflatable chamber is to be selected. Processor 205 may instruct controller 200 to select a particular chamber, or cell, or controller 200 may select a particular cell on its own. Controller 200 issues an operating command or signal to valve assembly 215 to a select a particular inflatable chamber, for example inflatable chamber 230. First valve plate 300 rotates relative to second valve plate 305 until aperture 350 or aperture 355 aligns with the outlet aperture 365 corresponding to inflatable chamber 230. Typically, an inflate operation, deflate operation and/or measurement operation follows a selection operation.

For an inflatable chamber inflation operation, controller 200 establishes that selected inflatable chamber 230 is to be filled with fluid. Processor 205 may instruct controller 200 to inflate the selected cell or the instruction may come from controller 200. In the embodiment illustrated in FIG. 7, fluid controller 265 of controller 200 sends an operating command or signal to fluid source 210 instructing the source to supply fluid into inflatable chamber 230 at a particular strength for a particular duration. Controller 200 also sends an operating command to three-way valve 250 that an inflate operation is about to occur. In response to the signals, three-way valve 250 is placed into the inflate position and fluid flows from fluid source 210 through check valve 260, three way valve 250 and into valve assembly 302.

Valve assembly 301 had previously selected inflatable chamber 230, which is now selected for an inflation operation. Fluid travels from fluid source 210 through conduit 312 into first housing aperture 375 and fluid chamber 311. The fluid then flows through either aperture 350 or aperture 355 into outlet aperture 365, conduit coupler 321, and conduit, or passage, 322 corresponding to inflatable chamber 230. Outlet aperture 365 is coupled to a conduit 322 that is connected to the chamber connector, or fitting, 155 of FIGS. 4–5 in inflatable chamber 230. Outlet aperture 365, the conduit 322 and the fitting 155 and aperture on inflatable chamber 230 form a fluid communication path between valve assembly 301 and the inflatable chamber of 230.

For an inflatable chamber deflation operation, controller 200 establishes that fluid is to be removed from selected inflatable chamber, or cell, 230. As stated previously for an inflate operation, processor 205 may instruct controller 200 to deflate the selected cell or the instruction may come from controller 200. Controller 200 sends an operating command or signal to three-way valve 250 that a deflate operation is about to occur. In response to the operating command from controller 200, three-way valve 250 is placed into the deflate position, thereby creating a fluid path from valve assembly 215 to the environment to release the fluid.

Valve assembly 215 had previously selected inflatable chamber 230, which is now selected for a deflation operation. Fluid travels from the inflatable chamber 230 through the chamber connector aperture and fitting 155 in the inflatable chamber 230 into the conduit 322 coupled to the fitting 155. The fluid then flows into conduit coupler 321 and outlet aperture 365 of second valve plate 305 that corresponds to inflatable chamber 230, through either first aperture 350 or second aperture 355 of first valve plate 300 and into fluid chamber 311. The fluid then passes out first housing aperture 375 disposed in valve housing 310 into conduit 312 and three-way valve 250. The fluid is then released into the environment.

For an inflatable chamber measurement operation, controller 200 establishes that the internal pressure of selected inflatable chamber, or cell, 230 is to be measured. Processor 205 may instruct controller 200 to take a pressure measurement from a particular cell or controller 200 may select a particular cell on its own. Controller 200 sends an operating command or signal to pressure sensor 255 that a measurement operation is about to occur. In response to the command from controller 200, pressure sensor 255 measures the internal pressure within the previously selected inflatable chamber 230.

Referring again to FIG. 8, valve housing 310 having an optical sensor 313 mounted thereon for use in an alignment operation is shown. In general, optical sensor 313 is used to detect the presence of a reflector on an unused outlet aperture 365 on second valve plate 305 to center valve assembly 301 in a home state, i.e. a state in which a wall member of the inflatable chamber is in a position without deflection. Optical sensor 313 consists of two parts, an emitter and a detector. The emitter produces a beam of visible or infrared light which is captured by the detector to produce a signal. Optical sensor 313 is preferably a retroreflective sensor, wherein the emitter and detector are adjacent to each other in the same housing. However, any suitable optical sensor may be used.

In an alignment operation, drive mechanism 302 rotates first valve plate 300 until the beam of visible or infrared light from optical sensor 313 passes through aperture 350. Since second housing aperture 380 of valve housing 310 is aligned with the reflector located on the unused aperture 365 of the second valve plate 305, the beam of visible or infrared light passes from the emitter of optical sensor 313 through aperture 350 and reflects back to the detector of the optical senor 313, thereby producing a signal. As such, valve assembly 301 is in alignment and the alignment signal is transmitted from the optical sensor 313 to controller 200.

Controller 200 also receives measurement information regarding the deflection of deflectable resistors 235, 240, 245 located on inflatable chambers, or cells, 220, 225, 230 respectively. Reading device 270 located within controller 205 is coupled to deflectable resistors 235, 240, 245. At prescribed periods of time, reading device 270 receives deflection signals from deflectable resistors 235, 240, 245. For example, if an individual's body is resting on inflatable chambers 220, 225, 230, the deflectable resistors sense a certain amount of deflection on each cell. In response, a deflection signal is transmitted from deflectable resistors 235, 240, 245 to the reading device 270 in controller 270. Reading device 270 then forwards the deflection signals to processor 205.

Processor 205 may use the deflection information from deflectable resistors 235, 240, 245 in a variety of ways. For example, the deflection information provides processor 205 with information regarding the position of a human body on inflatable chambers 220, 225, 230. Processor 205 may then instruct controller 205 to alter the pressure within the interior volumes of inflatable chambers 220, 225, 230 at prescribed intervals to vary the pressure exerted from the surface of the inflatable chambers on the skin of the individual, thereby reducing the formation of bedsores.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An inflatable mattress system comprising:

a first plurality of inflatable chambers each of which has an at least one wall member forming an interior volume, said wall member being made from a flexible material selected to retain fluid, each of said first plurality of inflatable chambers having a chamber connector for fluid communication with said interior volume, said at least one wall member being deflectable between a first inflated position and a second inflated position different from said first inflated position;

a second plurality of deflectable resistors each of which predictably varies its electrical resistance upon deflection from a first configuration to a second configuration when an electrical signal is applied thereto, each of said second plurality of deflectable resistors being attached to a wall member of an inflatable chamber of said first plurality of inflatable chambers to deflect therewith upon movement of said at least one wall member between said first inflated position and said second inflated position for generating a deflection signal reflective of said movement;

a fluid source for supplying a fluid under pressure into each interior volume of said first plurality of inflatable chambers;

a first conduit means connected to said chamber connector for communicating fluid to and from said interior volume;

a second conduit means connected to said fluid source for communicating fluid to and from said fluid source;

a discharge means for communicating fluid away from said inflatable mattress system from said interior volume;

a valve connected to said first conduit means, said second conduit means and said discharge means, said valve being operable among a first position in which said valve places said first conduit means in communication with said second conduit means for supplying fluid from said fluid source to said interior volume, a second position in which said valve places said first conduit means in fluid communication with said discharge means, and a third position in which said first conduit means is inhibited from communicating fluid to and from said interior volume; and a controller connected to each of said second plurality of deflectable resistors for supplying an electrical signal thereto and for receiving said deflection signal therefrom, said controller being configured to generate operating commands for operating said valve among said first position, said second position and said third position, said controller being connected to said valve to supply said operating commands to said valve.

2. The inflatable mattress of claim 1, wherein said controller includes a processor having a set of instructions for receiving said deflection signals and deriving an amount of said movement and directing said controller to deliver said operating commands.

3. The inflatable mattress system of claim 2, wherein said controller is a programmable device.

4. The inflatable mattress system of claim 3, wherein said controller is a programmable integrated circuit.

5. The inflatable mattress system of claim 3, wherein said controller is an application specific integrated circuit.

6. The inflatable mattress of claim 2, wherein said processor includes a set of instructions for directing said controller to deliver said operating commands for placing said valve in said first position, said second position and said third position.

7. The inflatable mattress of claim 2, wherein said controller further comprises a valve controller, communicatively coupled to said processor and said valve, said valve controller configured to receive an operating command to select an inflatable chamber in response to a command from said processor.

8. The inflatable mattress of claim 7, wherein said controller further comprises a reading device, communicatively coupled to said processor and said second plurality of deflectable resistors, said reading device configured for receiving said deflection signal and transmitting said deflection signal to said processor.

9. The inflatable mattress of claim 8, wherein said controller further comprises a fluid controller, communicatively coupled to said processor and said fluid source, said fluid controller configured for actuating said fluid source in response to an operating command from said processor.

10. The inflatable mattress of claim 1, further comprising a pressure sensor connected to said valve for measuring fluid pressure within said interior volume.

11. The inflatable mattress of claim 10, wherein said valve further comprises a fourth position in which said valve places said first conduit means in communication with said pressure sensor.

12. The inflatable mattress of claim 11, wherein said operating commands operate said valve among said first position, said second position, said third position and said fourth position.

13. The inflatable mattress of claim 1, wherein said valve further comprises a valve assembly having:

a valve housing, having an inlet for connecting said valve assembly to said fluid source;

a first valve plate having at least one plate aperture;

a second valve plate having a plurality of outlet apertures, said second valve plate being coupled to said valve housing forming a fluid chamber therebetween, said outlet apertures disposed at locations about said second valve plate that align with said at least one aperture; and a drive mechanism connected to the first valve plate, said drive mechanism configured to rotate said first valve plate relative to said second valve plate.

14. The inflatable mattress of claim 13, wherein said valve housing is coupled to an optical sensor having a transmitter and a receiver, wherein said at least one aperture of said first valve plate allows a light to pass through when aligned with a light from the transmitter, wherein an unused outlet aperture of said second valve plate has a reflector disposed thereon, wherein said optical sensor aligns said valve assembly by sending an alignment signal to said controller when said receiver senses said light from said transmitter reflected from said reflector on said second valve plate.

15. The inflatable mattress of claim 13, wherein said drive mechanism operates in response to said operating commands from said controller.

16. The inflatable mattress of claim 13, wherein each of said outlet apertures are coupled to a plurality of conduits, wherein each of said conduits is coupled to a chamber connector associated with an interior volume.

17. The valve assembly of claim 13, wherein said first valve plate is positioned within said fluid chamber.

18. The valve assembly of claim 13, wherein the plurality of outlet apertures are arranged substantially equal spaced around the second valve plate about a radius from the center point of the second valve plate.

19. The valve assembly of claim 13, wherein said at least one plate aperture comprises a first plate aperture and a second plate aperture and said outlet apertures on said second valve plate are configured to align with either said first plate aperture or said second plate aperture.

20. The valve assembly of claim 19, wherein the plurality of outlet apertures are arranged substantially equal spaced on said second valve plate about a first radius or a second radius, said first and second radius disposed from a center point of said second valve plate.

21. The valve assembly of claim 20, wherein said first plate aperture or second plate aperture align with said outlet apertures one outlet aperture at a time.

22. The valve assembly of claim 13, further comprising a seal disposed between said first valve plate and said second valve plate to create a relatively air-tight seal between said first and second valve plate within said fluid chamber.

23. The inflatable mattress of claim 13, wherein said first valve plate is disk shaped and said second valve plate is shaped to substantially match the shape of said first valve plate.

24. The inflatable mattress of claim 13, wherein said valve assembly further comprises a three-way valve, said three-way valve coupled to said fluid source, wherein a branch of said three-way valve is coupled to the atmosphere, wherein said three-way valve includes a first valve position for supplying said first plurality of inflatable chambers with fluid from said fluid source and a second valve position for discharging said fluid from said first plurality of inflatable chambers into the atmosphere.

25. The inflatable mattress of claim 1, wherein said fluid is air.

26. The inflatable mattress of claim 1, wherein said fluid is a liquid.

27. The inflatable mattress of claim 1, wherein said away from said inflatable mattress system is the atmosphere.

28. The inflatable mattress of claim 1, wherein said away from said inflatable mattress system is a reservoir coupled to said discharge means.

29. The inflatable mattress of claim 1, wherein said first plurality of inflatable chambers are equal in number to said second plurality of deflectable resistors.

30. The inflatable mattress of claim 1, wherein each chamber connector further comprises an aperture in said inflatable chamber coupled to a fitting.

31. The inflatable mattress of claim 1, further comprising a hospital bed for receiving said inflatable mattress system.

32. The inflatable mattress of claim 1, wherein said flexible material comprises a vinyl having a thickness in a range of 0.015 inches to 0.04 inches.

33. The inflatable mattress of claim 1, wherein said first plurality of inflatable chambers comprise a plurality of small inflatable chambers, a plurality of medium inflatable chambers, a plurality of large inflatable chambers and a plurality of elongated inflatable chambers.

34. The inflatable mattress of claim 33, wherein said first plurality of inflatable chambers are arranged in a pattern of 30 inflatable chambers to form said inflatable mattress.

35. The inflatable mattress of claim 33, wherein said plurality of small inflatable chambers are sized in a range of 8.3 inches by 6.4 inches to 9.3 inches by 7.4 inches, said plurality of medium inflatable chambers are sized in a range of 13.0 inches by 6.4 inches to 14.0 inches by 7.4 inches, said plurality of large inflatable chambers are sized in a range of 13.0 inches by 11.3 inches to 14.0 inches by 12.3 inches and said plurality of elongated inflatable chambers are sized in a range of 36.0 inches by 3.7 inches to 37.0 inches by 4.7 inches.

36. The inflatable mattress of claim 33, further comprising:

a first group of small inflatable chambers arranged where an individual's hips would typically contact said inflatable mattress system;

a second group of small inflatable chambers arranged where an individual's ankles would typically contact said inflatable mattress system; and a first group of elongated inflatable chambers arranged where an individual's head would typically contact said inflatable mattress system.

37. The inflatable mattress of claim 1, wherein said fluid source is a pump having a reservoir.

38. The inflatable mattress of claim 37, wherein said reservoir is accessible to the atmosphere.

39. The inflatable mattress of claim 38, wherein said fluid source is a vacuum pump, sufficiently sized to provide at least ½ lb. per square inch of air pressure in each of said plurality of inflatable chambers.

40. The inflatable mattress of claim 1, wherein said first inflated position is a position without deflection.

41. The inflatable mattress of claim 40, wherein said second inflated position results from a weight contacting said at least one wall member resulting in an amount of deflection of said at least one wall member detectable by a deflectable resistor associated with said at least one wall member.

42. An inflatable mattress system comprising:

a first plurality of inflatable chambers each of which has an at least one wall member forming an interior volume, each of said first plurality of inflatable chambers having a means for fluid communication with said interior volume, said at least one wall member being deflectable between a first inflated position and a second inflated position different from said first inflated position;

a second plurality of deflectable resistors each being attached to a wall member of an inflatable chamber of said first plurality of inflatable chambers to deflect therewith upon movement of said at least one wall member between said first inflated position and said second inflated position, said movement causing a deflection from a first resistor configuration having a first resistance to a second resistor configuration having a second resistance, for generating a deflection signal reflective of said change in resistance between said first resistance and said second resistance;

a fluid pump for supplying a fluid into each interior volume of said first plurality of inflatable chambers;

a first fluid passage connected to said means for fluid communication with said interior volume for communicating fluid to and from said interior volume;

a second fluid passage connected to said fluid pump for communicating fluid to and from said fluid pump;

a fluid discharge outlet for communicating fluid from said interior volume to a location exterior said interior volume;

a valve connected to said first fluid passage, said second fluid passage and said fluid discharge outlet, said valve being operable between a first position in which said valve places said first fluid passage in communication with said second fluid passage for supplying fluid from said fluid pump to said interior volume and a second position in which said valve places said first fluid passage in fluid communication with said fluid discharge outlet, said valve comprising, a valve housing, having an inlet for connecting said valve to said fluid pump, a first valve plate having at least one plate aperture, a second valve plate having a plurality of outlet apertures, said second valve plate being coupled to said valve housing forming a fluid chamber therebetween, said outlet apertures disposed at locations about said second valve plate that align with said at least one plate aperture, and a drive mechanism connected to the first valve plate, said drive mechanism configured to rotate said first valve plate relative to said second valve plate, a controller connected to each of said second plurality of deflectable resistors for supplying an electrical signal thereto and for receiving said deflection signal therefrom, said controller being configured to generate operating commands for operating said valve between said first position and said second position, and said controller being connected to said valve to supply said operating commands thereto; and a processor connected to said controller, said processor having a set of instructions for receiving said deflection signal, deriving an amount of said movement of said at least one wall member and directing said controller to deliver operating commands reflective of said derived amount of said movement.

43. The inflatable mattress system of claim 42, wherein said first resistor configuration is a home state where said at least one wall member is in said first inflated position.

44. The inflatable mattress system of claim 43, wherein said first inflated position is a position without deflection.

45. A valve assembly for selecting a single inflatable chamber of a multi-chambered inflatable mattress comprising:

a valve housing, having an inlet configured to connect said valve assembly to a fluid source;

a first valve plate having at least one aperture;

a second valve plate having a plurality of outlet apertures, the second valve plate being connected to the valve housing forming a fluid chamber therebetween, said plurality of outlet apertures disposed on said second valve plate such that each of said outlet apertures aligns with said at least one aperture, the alignment of said at least one aperture with each of said outlet apertures places said fluid chamber in fluid communication with an inflatable chamber associated with each of said outlet apertures; and a drive mechanism connected to the first valve plate, said drive mechanism configured to rotate said first valve plate relative to said second valve plate.

46. The valve assembly of claim 45, wherein said first valve plate is positioned within said fluid chamber.

47. The valve assembly of claim 45, wherein the plurality of outlet apertures are arranged substantially equal spaced around the second valve plate about a radius from the center point of the second valve plate.

48. The valve assembly of claim 45, wherein said at least one aperture comprises a first aperture and a second aperture and said outlet apertures on said second valve plate are configured to align with either said first aperture or said second aperture.

49. The valve assembly of claim 48, wherein the plurality of outlet apertures are arranged substantially equal spaced around said second valve plate about a first radius or a second radius, said first and second radius disposed from a center point of said second valve plate.

50. The valve assembly of claim 48, wherein said first or second aperture align with said outlet apertures one outlet aperture at a time.

51. The valve assembly of claim 45, wherein each of the outlet apertures are coupled to a plurality of conduits, wherein said conduits are configured to couple to a plurality of inflatable chambers of said multi-chambered inflatable mattress.

52. The valve assembly of claim 45, further comprising a seal disposed between said first valve plate and said second valve plate to create a relatively air-tight seal between said first and second valve plate, wherein said relatively air-tight seal allows fluid to flow from and to said fluid chamber without escaping through a gap created between said first and second valve plate.

53. The valve assembly of claim 45, wherein said valve housing is coupled to an optical sensor having a transmitter and a receiver, wherein said at least one aperture of said first valve plate allows a light to pass through when aligned with a light from the transmitter and an unused outlet aperture of said second valve plate has a reflector disposed thereon, wherein said at least one aperture and said unused outlet aperture are used to align said valve assembly by generating a signal when said receiver senses said light from said transmitter reflected from said reflector on said second valve plate passing through said at least one aperture of said first valve plate.

54. The valve assembly of claim 45, wherein the first valve plate is disk shaped and the second valve plate is shaped to substantially match the shape of the first valve plate.

55. The valve assembly of claim 45, wherein said drive mechanism is configured to place said at least one aperture of said first valve plate in fluid communication with each of said outlet apertures.

56. The valve assembly of claim 55, wherein said drive mechanism is a stepper motor.

57. The valve assembly of claim 45, wherein the second valve plate has 32 outlet apertures, 30 outlet apertures are coupled to 30 conduits, wherein the 30 conduits are configured to couple to 30 inflatable chambers.

58. An inflatable mattress comprising:

a first plurality of inflatable chambers each of which has an at least one wall member forming an interior volume, said wall member being made from a flexible material selected to retain fluid, each of said first plurality of inflatable chambers having a chamber connector for fluid communication with said interior volume, said at least one wall member being deflectable between a first inflated position and a second inflated position different from said first inflated position;

a second plurality of deflectable resistors each of which predictably varies its electrical resistance upon deflection from a first configuration to a second configuration when an electrical signal is applied thereto, each of said second plurality of deflectable resistors being attached to a wall member of an inflatable chamber of said first plurality of inflatable chambers to deflect therewith upon movement of said at least one wall member between said first inflated position and said second inflated position for generating a deflection signal reflective of said movement;

a first fluid passage connected to said chamber connector for communicating fluid to and from said interior volume;

a fluid discharge outlet for communicating fluid away from said inflatable mattress system from said interior volume; and a valve connected to said first fluid passage and said fluid discharge outlet, said valve being operable among a first position in which said valve places said first fluid passage in communication with a second fluid passage connected to said valve, a second position in which said valve places said first fluid passage in fluid communication with said fluid discharge outlet, and a third position in which said first fluid passage is inhibited from communicating fluid to and from said interior volume.

59. The inflatable mattress of claim 58, wherein said second fluid passage communicates fluid to and from a fluid source.

60. The inflatable mattress of claim 58, further comprising a controller connected to each of said second plurality of deflectable resistors for supplying an electrical signal thereto and for receiving said deflection signal therefrom, said controller being configured to generate operating commands for operating said valve between said first position, said second position and said third position, and said controller being connected to said valve to supply said operating commands thereto.

61. A method for selectively inflating and deflating a mattress comprising:

providing an inflatable mattress having a first plurality of inflatable chambers each of which has an at least one wall member forming an interior volume for retaining fluid, each of said first plurality of inflatable chambers having a chamber connector for fluid communication with said interior volume, said at least one wall member being deflectable between a first inflated position and a second inflated position different from said first inflated position;

providing a second plurality of deflectable resistors each of which predictably varies its electrical resistance upon deflection from a first configuration to a second configuration when an electrical signal is applied thereto;

attaching each of said second plurality of deflectable resistors to a wall member of an inflatable chamber of said first plurality of inflatable chambers to deflect therewith upon movement of said at least one wall member between said first inflated position and said second inflated position for generating a deflection signal reflective of said movement;

providing a fluid source for supplying a fluid under pressure into each interior volume of said first plurality of inflatable chambers;

providing a fluid discharge outlet for communicating fluid away from said inflatable mattress system from said interior volume;

connecting said chamber connector to a first fluid passage for communicating fluid to and from said interior volume;

connecting said fluid source to a second fluid passage for communicating fluid to and from said fluid source;

connecting a valve to said first fluid passage, said second fluid passage and said fluid discharge outlet, said valve being operable between a first position in which said valve places said first fluid passage in communication with said second fluid passage for supplying fluid from said fluid source to said interior volume, a second position in which said valve places said first fluid passage in fluid communication with said fluid discharge outlet and a third position in which said first fluid passage is inhibited from communicating fluid to and from said interior volume; and connecting a controller to each of said second plurality of deflectable resistors for supplying an electrical signal thereto and for receiving said deflection signal therefrom, said controller being configured to generate operating commands for operating said valve between said first position, said second position and said third position, and said controller being connected to said valve to supply said operating commands thereto.

62. The method of claim 61, further comprising:

supplying an electrical signal to at least one of said second plurality of deflectable resistors to measure a first resistance associated with said first configuration;

supplying an electrical signal to said at least one of said second plurality of deflectable resistors to measure a second resistance associated with said second configuration;

receiving a change in resistance between said first resistance and said second resistance in said deflection signal at said controller; and adjusting the level of fluid within an inflatable chamber associated with said at least one of said second plurality of deflectable resistors in response to said deflection signal.

63. The method of claim 62, wherein said adjusting the level of fluid further comprises at least one of supplying fluid from said fluid source into said inflatable chamber associated with said at least one of said second plurality of deflectable resistors for a measured period of time, discharging fluid from said inflatable chamber associated with said at least one of said second plurality of deflectable resistors to the environment for a measured period of time, and measuring fluid pressure within said inflatable chamber associated with said at least one of said second plurality of deflectable resistors, wherein said measured period of time is derived from said resistance.

64. The method of claim 61, further comprising connecting a processor to said controller, said processor having a set of instructions for receiving said deflection signal from said controller and directing said valve to select an inflatable chamber from said first plurality of inflatable chambers in response to said deflection signal.

65. The method of claim 64, further comprising providing said processor with a set of instructions for directing said valve to take a fluid pressure reading from said selected inflatable chamber.

66. The method of claim 65, further comprising providing said processor with a set of instructions for directing said valve to select said first position, said second position and said third position.

67. The method of claim 61, wherein coupling a valve to said first plurality of inflatable chambers and said fluid source further comprises:

connecting a drive mechanism to a first valve plate having at least one plate aperture;

connecting a valve housing to a second valve plate having a plurality of outlet apertures coupled to said plurality of inflatable chambers, wherein said second valve plate and said valve housing form a fluid chamber therebetween;

positioning said first valve plate within said fluid chamber; and configuring said drive mechanism to rotate said first valve plate relative to said second valve plate in response to information from said controller for supplying fluid from said fluid chamber to said outlet apertures.

68. The method of claim 67, further comprising configuring said plurality of outlet apertures on said second valve plate to align each outlet aperture with said at least one plate aperture.

69. The method of claim 68, wherein said at least one plate aperture comprises a first plate aperture and a second plate aperture and said outlet apertures on said second valve plate are configured to align with either said first plate aperture or said second plate aperture.

70. The method of claim 69, wherein said supplying fluid from said fluid chamber to said outlet apertures further comprises supplying fluid from said fluid chamber to said plurality of outlet apertures a single aperture at a time.

71. The method of claim 67, further comprising:

providing an optical sensor to perform an alignment operation;

transmitting a light from said optical sensor through said at least one aperture of the first plate;

providing a reflector disposed on an unused outlet aperture of said second valve plate; and aligning said valve assembly by sending a signal to said controller when said optical sensor receives said light returned from said reflector.

72. A method for inflating a mattress comprising:

providing an inflatable mattress having a first plurality of inflatable chambers each of which has an at least one wall member forming an interior volume for retaining fluid therein, each of said first plurality of inflatable chambers having a chamber connector for fluid communication with said interior volume, said at least one wall member being deflectable between a first inflated position and a second inflated position different from said first inflated position;

providing a second plurality of deflectable resistors each of which deflects from a first resistor configuration having a first resistance to a second resistor configuration having a second resistance for generating a deflection signal reflective of said change in resistance between said first resistance and said second resistance;

attaching each of said second plurality of deflectable resistors to said wall member to deflect with said at least one wall member upon movement of said at least one wall member between said first inflated position corresponding to said first resistor configuration and said second inflated position corresponding to said second resistor configuration;

providing a fluid source for supplying a fluid under pressure into each interior volume of said first plurality of inflatable chambers;

providing a fluid discharge outlet for communicating fluid away from said inflatable mattress system from said interior volume;

connecting said chamber connector to a first fluid passage for communicating fluid to and from said interior volume;

connecting said fluid source to a second fluid passage for communicating fluid to and from said fluid source;

connecting a valve means to said first fluid passage, said second fluid passage and said fluid discharge outlet;

connecting a controller to each of said second plurality of deflectable resistors for supplying an electrical signal thereto and for receiving said deflection signal therefrom, said controller being configured to generate operating commands for operating said valve means, and said controller being connected to said valve means to supply said operating commands thereto;

supplying an electrical signal from said controller to at least one of said second plurality of deflectable resistors to measure said change in resistance;

receiving a deflection signal at said controller from said at least one of said second plurality of deflectable resistors; and adjusting a fluid level within an inflatable chamber attached to said at least one of said second plurality of deflectable resistors.

73. The method of claim 72, wherein said adjusting the level of fluid further comprises at least one of supplying fluid from a fluid source into said inflatable chamber attached to said at least one of said second plurality of deflectable resistors for a first measured period of time, discharging fluid from said inflatable chamber attached to said at least one of said second plurality of deflectable resistors to the environment for a second measured period of time, and measuring fluid pressure within said inflatable chamber attached to said at least one of said second plurality of deflectable resistors, wherein said first measured period of time and second measured period of time are derived from said deflection signal.

* * * * *